US007168359B2

(12) United States Patent
Ota et al.

(10) Patent No.: US 7,168,359 B2
(45) Date of Patent: Jan. 30, 2007

(54) SWASH PLATE COMPRESSOR

(75) Inventors: Masaki Ota, Kariya (JP); Hajime Kurita, Kariya (JP); Yuji Kaneshige, Kariya (JP); Masakazu Murase, Kariya (JP); Tetsuhiko Fukanuma, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 43 days.

(21) Appl. No.: 11/020,452

(22) Filed: Dec. 22, 2004

(65) Prior Publication Data

US 2005/0145105 A1 Jul. 7, 2005

(30) Foreign Application Priority Data

Dec. 25, 2003 (JP) ..... 2003-431617

(51) Int. Cl.
*F01B 3/02* (2006.01)

(52) U.S. Cl. ..... 92/71

(58) Field of Classification Search ..... 92/12.2, 92/71

See application file for complete search history.

(56) References Cited

U.S. PATENT DOCUMENTS 1,714,145 A * 5/1929 Sperry ..... 92/71

FOREIGN PATENT DOCUMENTS

| | | |
|---|---|---|
| JP | 60-219479 | 11/1985 |
| JP | 61-149588 | 7/1986 |
| JP | 2001-32768 | 2/2001 |

* cited by examiner

*Primary Examiner*—F. Daniel Lopez
(74) *Attorney, Agent, or Firm*—Morgan & Finnegan, L.L.P.

(57) ABSTRACT

A swash plate compressor that prevents a slide plate from being separated from a swash plate. The compressor includes a drive shaft. A slide plate is rotatable relative to the swash plate. Two shoes is arranged on the swash plate and the slide plate. A bearing arranged between the swash plate and the slide plate and in between the shoes. A piston is connected to the swash plate and the slide plate by the shoes and is reciprocated to compress gas. The swash plate includes a swash plate support surface, and the slide plate includes a slide plate support surface, in which each surface is for contacting the bearing. The swash plate is formed so that a clearance between the swash plate support surface and the slide plate support surface increases radially inwardly of the swash plate and the slide plate.

9 Claims, 4 Drawing Sheets

SWASH PLATE COMPRESSOR

BACKGROUND OF THE INVENTION

The present invention relates to a swash plate compressor for compressing refrigerant gas in, for example, a refrigerant circuit for a vehicle air conditioner.

A typical swash plate compressor includes a drive shaft and a swash plate connected to the drive shaft so as to rotate integrally with the drive shaft. Single headed pistons are connected to the peripheral portion of the swash plate by pairs of shoes. As the swash plate rotates when the drive shaft rotates, the swash plate rotates between the shoes as it wobbles with respect to the axial direction of the drive shaft. This reciprocates each piston to compress refrigerant gas.

In the swash plate compressor, the swash plate is in slidably contact with the shoes. Accordingly, a relatively large mechanical loss occurs at portions where sliding occurs between the swash plate and the shoes. This results in a problem, such as seizing, at the sliding portions.

FIG. 1 shows a structure proposed to solve such a problem (refer to Japanese Laid Open Patent Publication No. 2001-32768). A swash plate 92 has a rear surface (right surface as viewed in FIG. 1) that receives compression reaction from pistons 96. A thrust race 95 (slide plate) is supported on the rear surface of the swash plate 92 in a manner enabling relative rotation between the thrust race 95 and the swash plate 92. The thrust race 95 is arranged between the swash plate 92 the shoes 93B that transmit compression reaction from the pistons 96 to the swash plate 92). Thus, the thrust race 95 moves between the swash plate 92 and the shoes 93B. Needle rollers 94 (roller bearings) for smoothing relative rotation between the swash plate 92 and the thrust race 95 are arranged between the swash plate 92 and the thrust race 95, and between the shoes 93A and 93B.

As a drive shaft 91 integrally rotates the swash plate 92, the needle rollers 94 roll and move the thrust race 95 relative to the swash plate 92. Accordingly, the rotation speed of the thrust race 95 is lower than the rotation speed of the swash plate 92. In other words, the rotation speed of the thrust race 95 relative to the shoes 93B is lower than the rotation speed of the swash plate 92 relative to the shoes 93B. Thus, the needle rollers 94 reduce sliding resistance between the thrust race 95 and the shoes 93B. This reduces mechanical loss and prevents abrasion and seizing of the shoes 93B.

However, in the structure of Japanese Laid-Open Patent Publication No. 2001-32768, insufficient lubrication may occur at portions of contact between each piston 96 and the associated shoes 93A and 93B. Such problem will now be discussed with reference to FIG. 2 that schematically shows the vicinity of the peripheral portion of the swash plate 92.

Compression reaction (the load center of which is indicated by arrow X to facilitate understanding) is applied to the rear surface of the swash plate 92 via the shoes 93B, the thrust race 95, and the needle rollers 94 when a piston 96 (refer to FIG. 1) is in the compression stroke. More specifically, compression reaction X is applied in an eccentric manner to the rear surface of the swash plate 92 about the axis L of the drive shaft 91.

The swash plate 92 has a roller surface 92*a* for receiving the needle rollers 94 and a shoe surface 92*b* for receiving the shoes 93A. The thrust race 95 has a roller surface 95*a* for receiving the needle rollers 94. When compression reaction X does not act on the rear surface of the swash plate 92, the distance between a roller surface 92*a* of the swash plate 92 and a roller surface 95*a* of the thrust race 95 is uniform at all locations. Further, the roller surface 92*a* and the shoe surface 92*b* of the swash plate 92 are parallel to a hypothetical plane H that is perpendicular to the axis of the swash plate 92.

The peripheral portion of the swash plate 92 is partially flexed (lower portion as viewed in FIG. 2) when compression reaction X acts on the rear surface of the swash plate 92. As shown in FIG. 2, the needle rollers 94 located in the flexed portion of the swash plate 92 are inclined relative to the hypothetical plane H. In the same manner, the thrust race 95 is also inclined relative to the hypothetical plane H. Accordingly, a clearance CL between the roller surface 92*a* and the roller surface 92*a* is increased. In FIG. 2, the flexing of the swash plate 92 and the inclination of the needle rollers 94 and the thrust race 95 are shown in an exaggerated manner.

When the thrust race 95 is inclined relative to the hypothetical surface H, the portion of the thrust race 95 located on the side opposite to the flexed portion of the swash plate 92 (more specifically, the portion corresponding to the piston 96 that is in the suction stroke) is greatly separated from the swash plate 92 (as shown in upper part of FIG. 2). The gap between the shoes 93A and 93B widens at portions where the swash plate 92 is greatly separated from the thrust race 95. This reduces or eliminates the clearances of contact parts such as between the shoes 93A and 93B and the pistons 96, between the shoes 93A and the swash plate 92, and between the shoes 93B and the thrust race 95. As a result, the supply of lubricant (refrigerant oil) to contact parts becomes difficult. This increases slide resistance and noise.

SUMMARY OF THE INVENTION

It is an object of the present invention to provide a swash plate compressor that prevents part of the slide plate from being greatly separated from the swash plate.

One aspect of the present invention is a swash plate compressor for compressing a gas. The compressor includes a rotatable drive shaft. A swash plate is connected to the drive shaft in a manner enabling integral rotation with the drive shaft. A slide plate is supported to be rotatable relative to the swash plate. A pair of shoes is arranged on the swash plate and the slide plate. A bearing is arranged between the swash plate and the slide plate and in between the shoes. A piston is connected to the swash plate and the slide plate by the shoes. The piston is reciprocated to compress gas when the rotation of the drive shaft rotates the swash plate. The swash plate includes a swash plate support surface for contacting the bearing. The slide plate includes a slide plate support surface for contacting the bearing. At least one of the swash plate and the slide plate is formed so that a clearance between the swash plate support surface and the slide plate support surface increases radially inwardly of the swash plate and the slide plate.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A variable displacement compressor 10 according to a preferred embodiment of the present invention will now be described with reference to FIGS. 3 to 5. The compressor 10 forms part of a refrigerant circuit 70 in a vehicle air conditioner and compresses refrigerant gas (e.g., carbon dioxide).

Figure 1:
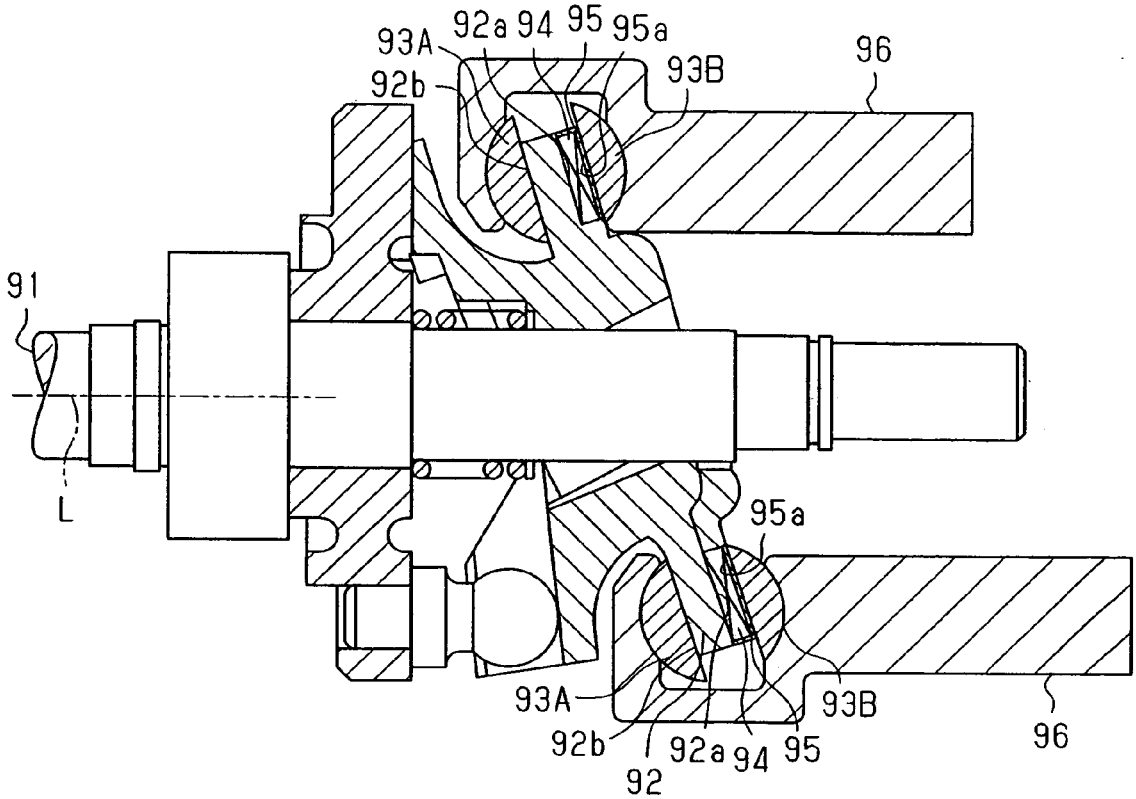
Fig.1 (Prior Art)
FIG. 1 is a partial cross-sectional view of a swash plate compressor in the prior art.
Figure 2:
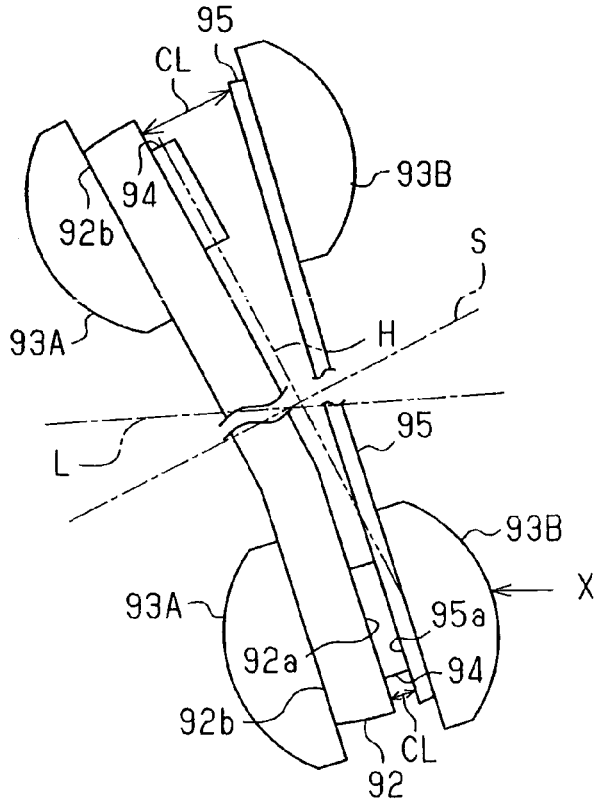
Fig.2 (Prior Art)
FIG. 2 is a schematic diagram showing the vicinity of a swash plate when compression reaction is applied thereto in the compressor of FIG. 1.
Figure 3:
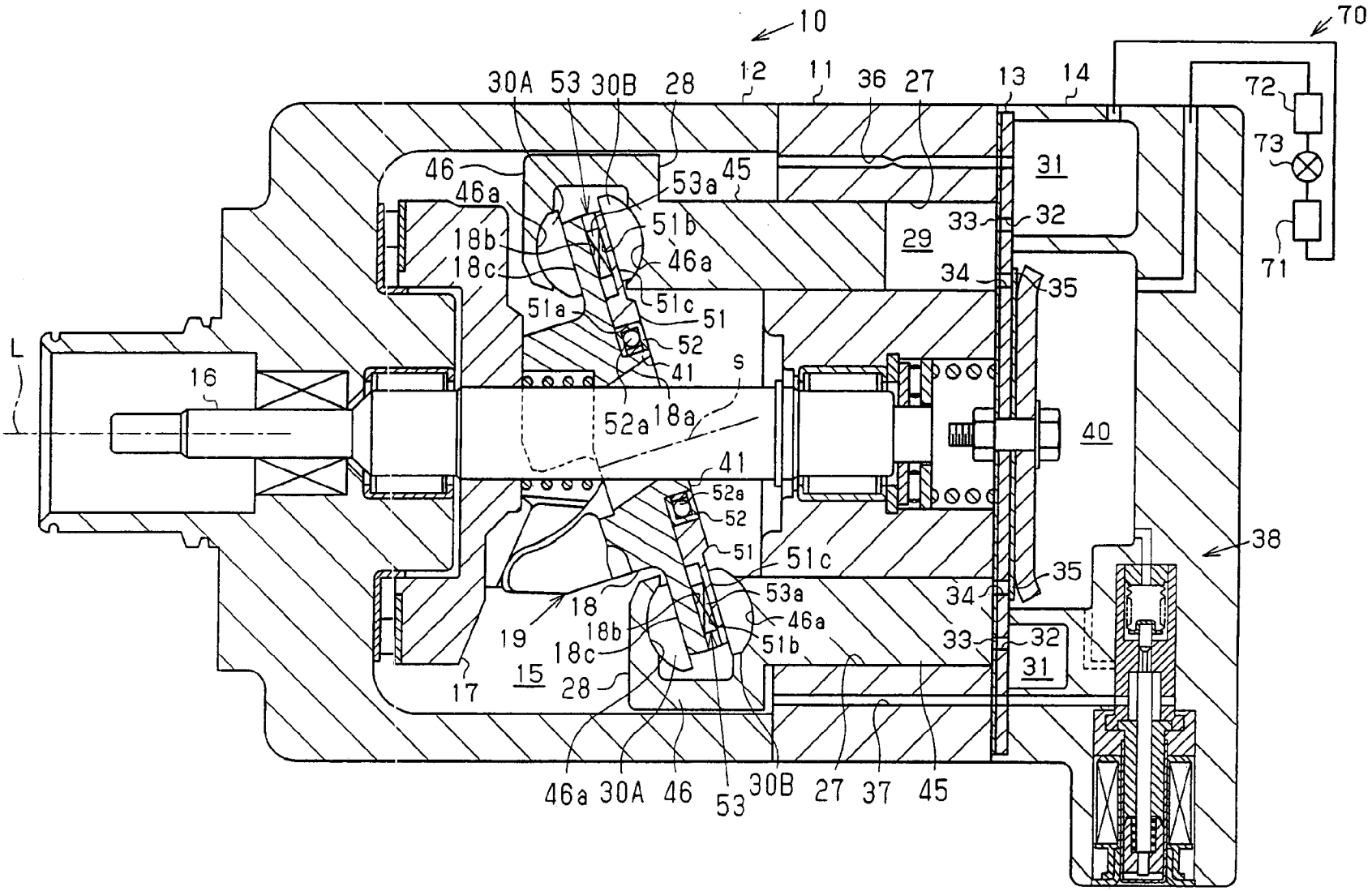
FIG. 3 is a cross-sectional view of a swash plate compressor according to a preferred embodiment of the present invention.

FIG. 3 is a cross-sectional view of the compressor 10. The left side as viewed in FIG. 3 is the front side of the compressor 10, and the right side as viewed in FIG. 3 is the rear side of the compressor 10. The compressor 10 has a housing formed by a cylinder block 11, a front housing 12 fixed to the front end of the cylinder block 11, and a rear housing 14 fixed to the rear end of the cylinder block 11 with a valve plate 13 arranged therebetween.

A crank chamber 15 is defined in the housing between the cylinder block 11 and the front housing 12. A drive shaft 16 is supported in a rotatable manner between the cylinder block 11 and the front housing 12. The drive shaft 16 is connected to an engine (not shown), which functions as a vehicle drive source. The drive shaft 16 is rotated when powered by the engine.

A lug plate 17, which is substantially disk-shaped, is fixed to and rotated integrally with the drive shaft 16 in the crank chamber 15. The swash plate 18 is accommodated in the crank chamber 15. An insertion hole 18*a* extends through the central portion of the swash plate 18. The drive shaft 16 is inserted through the insertion hole 18*a*. A hinge mechanism 19 is arranged between the lug plate 17 and the swash plate 18. The swash plate 18 is connected to the lug plate 17 by the hinge mechanism 19 and supported by the drive shaft 16 by means of the insertion hole 18*a*. This rotates the swash plate 18 in synchronism with the lug plate 17 and the drive shaft 16. Further, the swash plate 18 slides on the drive shaft 16 along the direction of axis L while inclining relative to the drive shaft 16.

A plurality of cylinder bores 27 extend through the cylinder block 11 parallel to the axis L. The cylinder bores 27 are arranged about the axis L at equal angular intervals. A single-headed piston 28 is retained in a movable manner in each cylinder bore 27. The piston 28 includes a cylindrical head 45, which is arranged in the cylinder bore 27, and a skirt 46, which is arranged in the crank chamber 15 outside the cylinder bore 27. The head 45 and the skirt 46 are formed integrally with each other and extend parallel to the axis L. The cylinder bore 27 has a front opening closed by the head 45 of the piston 28 and a rear opening closed by the front surface of the valve plate 13. A compression chamber 29 is defined in the cylinder bore 27. The volume of the compression chamber 29 varies in accordance with the movement of the piston 28.

Two shoe seats 46*a* are defined in the skirt 46 of each piston 28. Two semispherical shoes 30A and 30B are retained in the skirt 46. More specifically, each shoe seat 46*a* receives the spherical surface of the shoe 30A or 30B. Each piston 28 is connected to the peripheral portion of the swash plate 18 by the two shoes 30A and 30B. The connection between the swash plate 18 and the piston 28 will be described later. When rotation of the drive shaft 16 rotates the swash plate 18, the swash plate 18 wobbles relative to the axis L of the drive shaft 16. The wobbling of the swash plate 18 reciprocates the piston 28 in a direction parallel to the axis L.

A suction chamber 31 and a discharge chamber 40 are defined in the housing between the valve plate 13 and the rear housing 14. A suction port 32 and a suction valve 33 are formed between each compression chamber 29 and the suction chamber 31 in the valve plate 13. Further, a discharge port 34 and a discharge valve 35 are formed between each compression chamber 29 and the discharge chamber 40 in the valve plate 13.

Refrigerant gas is drawn into the suction chamber 31 from an evaporator 71 in the refrigerant circuit 70. Movement of each piston 28 from the top dead center position to the bottom dead center position draws the refrigerant gas from the suction chamber 31 into the corresponding compression chamber 29 through the associated suction port 32 and suction valve 33. Movement of the piston 28 from the bottom dead center position to the top dead center position compresses the refrigerant gas in the compression chamber 29 to a predetermined pressure and then discharges the refrigerant gas into the discharge chamber 40 through the associated discharge port 34 and discharge valve 35. The refrigerant gas in the discharge chamber 40 is sent to and cooled by a gas cooler 72 in the refrigerant circuit 70. Then, the refrigerant gas is depressurized by an expansion valve 73 and sent to an evaporator 71. The evaporator 71 vaporizes the refrigerant gas.

A bleed passage 36, a gas supply passage 37, and a control valve 38 are provided in the housing of the compressor 10. The bleed passage 36 connects the crank chamber 15 and the suction chamber 31. The gas supply passage 37 connects the discharge chamber 40 and the crank chamber 15. The control valve 38, which is known in the art, is arranged in the gas supply passage 37. The open degree of the control valve 38 is adjusted to control the balance between the amount of high-pressure discharge gas drawn into the crank chamber 15 through the gas supply passage 37 and the amount of gas discharged from the crank chamber 15 through the bleed passage 36. This determines the pressure of the crank chamber 15.

As the pressure of the crank chamber 15 changes, the difference between the pressure of the crank chamber 15 and the pressure of the compression chambers 29 also changes. This alters the inclination angle of the swash plate 18 (angle between the swash plate 18 and a hypothetical plane that is perpendicular to the axis L). As a result, the stroke of the pistons 28, or the displacement of the compressor 10, is adjusted. For example, a decrease in the pressure of the crank chamber 15 would increase the inclination angle of the swash plate 18. This would lengthen the stroke of the pistons 28 and increase the displacement of the compressor 10. Conversely, an increase in the pressure of the crank chamber 15 would decrease the inclination angle of the swash plate 18. This would shorten the stroke of the pistons 28 and decrease the displacement of the compressor 10.

The structure for connecting the pistons 28 to the swash plate 18 will now be discussed.

As shown in FIG. 3, a substantially cylindrical support 41 projects from the central rear surface of the swash plate 18 around the drive shaft 16. An annular slide plate 51 is arranged on the swash plate 18 at the outer side of the support 41. A support hole 51*a* extends through the central portion of the slide plate 51. The support 41 is inserted through the support hole 51*a*. The slide plate 51 is made of a material that provides the slide plate 51 with satisfactory flexibility. The outer wall surface of the support 41 is separated from the inner wall surface of the support hole 51*a* by a predetermined distance to form a gap. A radial bearing 52, which includes a plurality of balls 52*a*, is arranged in the gap.

On the swash plate 18, a thrust bearing 53 (roller bearing) is arranged between the swash plate 18 and the rear shoes 30B (the shoes 30B that receive compression reaction from the pistons 28), that is, between the shoes 30A and 30B. In other words, the thrust bearing 53 is arranged between the peripheral rear surface of the swash plate 18 and the peripheral front surface of the slide plate 51. The thrust bearing 53 includes a plurality of rollers 53*a*. The rollers 53*a* are arranged along the circumferential direction of the swash plate 18.

An annular swash plate support surface 18*b* is defined on the peripheral rear surface of the swash plate 18 about the axis S of the swash plate 18. The swash plate support surface 18*b* receives the thrust bearing 53. The rollers 53*a* of the thrust bearing 53 are arranged on the swash plate support surface 18*b* in a rollable manner. Thus, the swash plate support surface 18*b* functions as a roll surface for the rollers 53*a*.

An annular slide plate support surface 51*b* is defined on the peripheral front surface of the slide plate 51. The slide plate support surface 51*b* receives the thrust bearing 53. The rollers 53*a* of the thrust bearing 53 are arranged on the slide plate support surface 51*b* in a rollable manner. Thus, the slide plate support surface 51*b* functions as a roll surface for the rollers 53*a*.

As described above, the radial bearing 52 and the thrust bearing 53 support the slide plate 51 so that it is rotatable relative to the swash plate 18. Accordingly, when the rotation of the drive shaft 16 rotates the swash plate 18, the rolling of the balls 52*a* in the radial bearing 52 and the rollers 53*a* in the thrust bearing 53 causes sliding between the swash plate 18 and the slide plate 51. Thus, the rotation speed of the slide plate 51 is lower than the rotation speed of the swash plate 18. In other words, the rotation speed of the slide plate 51 relative to the shoe 30B is lower than the rotation speed of the swash plate 18 relative to the shoe 30B. Accordingly, slide resistance between the slide plate 51 and the shoe 30B is reduced. This reduces mechanical loss and prevents abrasion and seizing of the shoe 30B.

Figure 4:
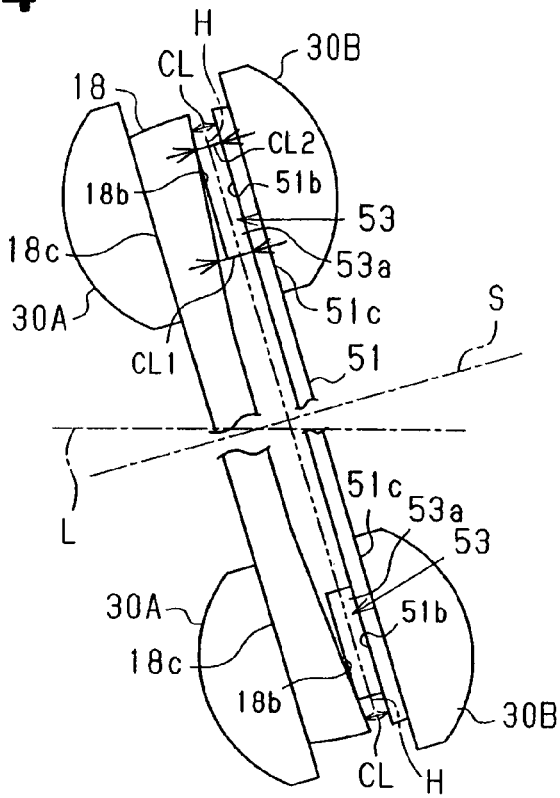
FIG. 4 is a schematic diagram showing the vicinity of a swash plate that is included in the compressor of FIG. 3.

FIG. 4 is a schematic diagram showing the vicinity of the peripheral portion of the swash plate 18. As shown in FIG. 4, a clearance CL is provided between the swash plate support surface 18*b* and the slide plate support surface 51*b*. In comparison to the radially outer side of the swash plate 18, the clearance CL is larger at the radially inner side of the swash plate 18.

The slide plate support surface 51*b* has a plane parallel to the hypothetical plane H. The swash plate support surface 18*b* is inclined relative to the slide plate support surface 51*b*, or the hypothetical plate H, so that it is gradually spaced from the slide plate support surface 51*b* radially inwardly of the swash plate 18. In other words, the swash plate support surface 18*b* is formed by part of a conical surface. Accordingly, the clearance CL between the swash plate support surface 18*b* and the slide plate support surface 51*b* gradually increases radially inwardly of the swash plate 18.

An annular slide surface 18*c* for the shoes 30A is defined on the front peripheral surface of the swash plate 18 about the axis S of the swash plate 18. The slide surface 18*c* is parallel to the hypothetical plane H. An annular slide surface 51*c* for the shoes 30B is defined on the rear peripheral surface of the slide plate 51. The slide surface 51*c* is parallel to the hypothetical plane H.

In the region where the rollers 53*a* are arranged, the difference between the clearance CL at where it is largest (indicated by CL1 in FIG. 4) and the clearance CL at where it is smallest (indicated by CL2 in FIG. 4) is about several tens of micrometers. In FIG. 4, to facilitate understanding, the difference between the clearance CL at the inner side of the swash plate 18 and the clearance CL at the outer side of the swash plate 18, that is, the inclination of the swash plate support surface 18*b* relative to the slide plate support surface 51*b* is shown in an exaggerated manner.

Figure 5A:
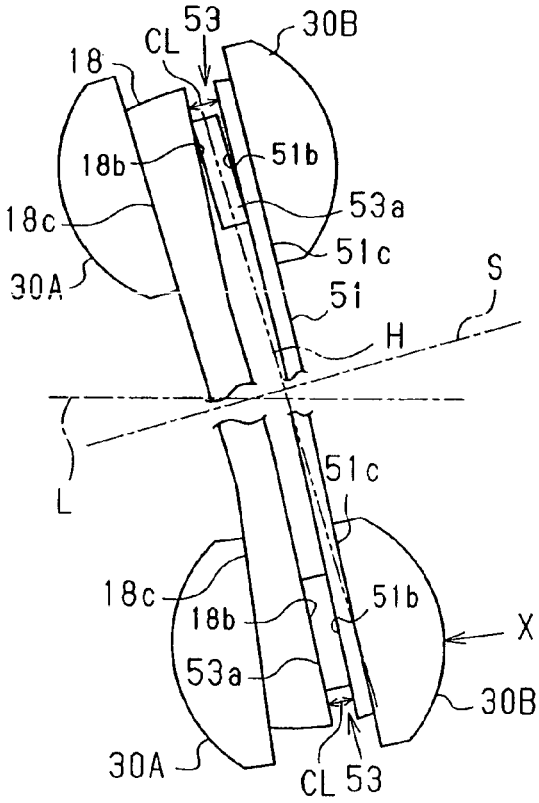
FIGS. 5A and 5B are schematic side views showing the vicinity of the swash plate when compression reaction is applied thereto.

As shown in FIG. 5A, compression reaction (the load center of which is indicated by arrow X to facilitate understanding) is applied to the rear surface of the swash plate 18 from the piston 28 that is in the compression stroke via the associated shoe 30B, the slide plate 51, and the thrust bearing 53. More specifically, compression reaction X is applied in an eccentric manner to the rear surface of the swash plate 18 about the axis L of the drive shaft 16. The compression reaction X is relatively large when the displacement of the compressor 10 is relatively large. This flexes the peripheral portion of the swash plate 18 at parts to which the compression reaction X is applied (refer to lower part of FIG. 5A).

In the preferred embodiment, the swash plate support surface 18*b* is formed so that the clearance CL at the inner side of the swash plate 18 is greater than the clearance CL at the outer side of the swash plate 18. This prevents the difference between the clearances CL at the outer and inner sides of the swash plate 18 from being large when the swash plate 18 is flexed as described above. Thus, the slide plate 51 and the rollers 53*a* of the thrust bearing 53 are prevented from being inclined greatly relative to the hypothetical plane H.

Consequently, the portion of the slide plate 51 located on the side opposite to the flexed portion of the swash plate 18 (more specifically, the portion corresponding to the piston 28 that is in the suction stroke) is prevented from being greatly separated from the swash plate 18 (refer to upper part of FIG. 5A). Thus, the gap between the shoes 30A and 30B is prevented from being widened. Further, the clearances of contact parts such as between the shoes 30A and 30B and the associated shoe seat 46*a* of each piston 28, between the shoes 30A and the swash plate 18, and between the shoes 30B and the slide plate 51 are prevented from being reduced or eliminated. As a result, lubricant (refrigerant oil) is supplied to contact parts in an optimal manner. Further, slide resistance and noise are prevented from being increased at the contact parts.

The above effect is obtained as long as there is a slight difference between the clearances CL at the inner and outer sides of the swash plate 18. The effect is more prominent when the difference between the largest clearance CL1 and the smallest clearance CL2 is 30 μm or greater (refer to FIG. 4). The distance between the clearances CL1 and CL2 is preferably 40 μm or greater, further preferably 50 μm or greater, more preferably 60 μm or greater, and most preferably 70 μm or greater.

The compressor 10 has the advantages described below.

(1) The slide plate support surface 51*b* is parallel to the hypothetical plane H, which is perpendicular to the axis S of the swash plate 18. The swash plate support surface 18*b* is inclined relative to the hypothetical plane H so that it is gradually spaced from the slide plate support surface 51*b* radially inwardly of the swash plate 18. Thus, the clearance CL between the swash plate support surface 18*b* and the slide plate support surface 51*b* gradually increases toward the radially inner side of the swash plate 18.

Consequently, the clearance CL between the swash plate support surface 18*b* and the slide plate support surface 51*b* does not increase even if the swash plate 18 is flexed. Therefore, the clearances between the shoes 30A and 30B and the associated shoe seat 46*a* of each piston 28, the shoes 30A and the swash plate 18, and the shoes 30B and the slide plate 51 are prevented from being reduced or eliminated. As a result, lubricant (refrigerant oil) is supplied to contact parts in an optimal manner.

Even if the swash plate 18 is flexed, the thrust bearing 53 is held more stably between the swash plate support surface 18*b* and the slide plate support surface 51*b* in comparison to when, for example, at least one of the swash plate support surface 18*b* and the slide plate support surface 51*b* is formed in a stepped manner from the radially outer side to the radially inner side of the swash plate 18. A compressor including such a stepped swash plate would not depart from the spirit or scope of the invention.

The swash plate support surface 18*b* and the slide plate support surface 51*b* function as the roll surfaces of the thrust bearing 53 (rollers 53*a*). Thus, the rollers 53*a* roll stably. Accordingly, the slide plate 51 rotates smoothly relative to the swash plate 18. This reduces mechanical loss and prevents abrasion and seizing of the shoes 30B.

Figure 5B:
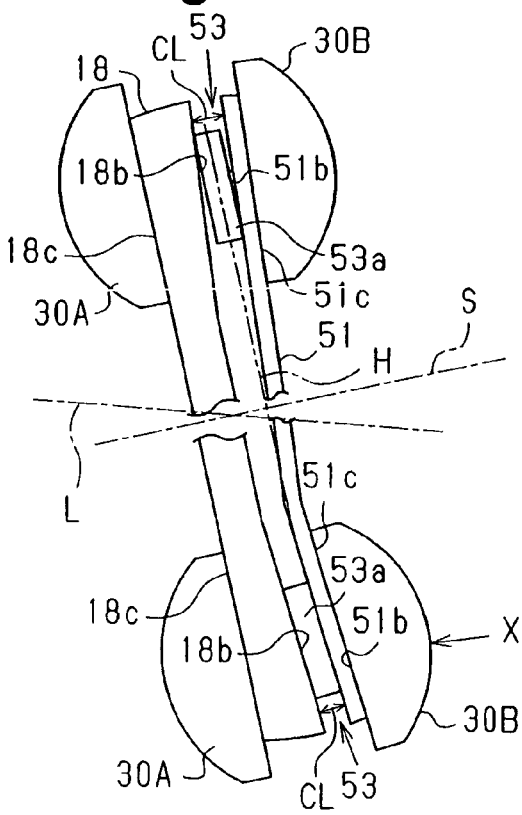

(2) When the displacement of the compressor 10 is relatively small, the compression reaction X is relatively small and the swash plate 18 is not flexed. However, as shown in FIG. 5B, the relatively small compression reaction X flexes the slide plate 51, which is flexible, in a state in which the swash plate 18 is not deformed. More specifically, the slide plate 51 is deformed so that the slide plate support surface 51*b* extends parallel to the swash plate support surface 18*b*, and the thrust bearing 53 is stably held between the swash plate support surface 18*b* and the slide plate support surface 51*b*. As a result, the rollers 53*a* of the thrust bearing 53 (roller 53*a* at the lower part of FIG. 5B) entirely contact the swash plate support surface 18*b* and the slide plate support surface 51*b*. Therefore, at portions directly receiving the compression reaction X, the load applied to the rollers 53*a* is reduced, and the durability of the thrust bearing 53 is improved.

(3) The compressor 10 compresses the refrigerant (refrigerant gas) of the refrigerant circuit 70. Carbon dioxide is used as the refrigerant of the refrigerant circuit 70. When using a carbon dioxide refrigerant, the compression reaction X acting on the pistons 28 is increased in comparison to when using, for example, a FREON refrigerant. Accordingly, more reaction force X is applied to the swash plate 18 in an eccentric manner. Thus, there is a higher tendency for part of the swash plate 18 to be flexed. Further, in the prior art, part of the slide plate is greatly separated from the swash plate. Accordingly, the preferred embodiment is especially advantageous in that the slide plate 51 is prevented from being partially separated from the swash plate 18 when the compressor 10 compresses carbon dioxide.

It should be apparent to those skilled in the art that the present invention may be embodied in many other specific forms without departing from the spirit or scope of the invention. Particularly, it should be understood that the present invention may be embodied in the following forms.

Figure 6:
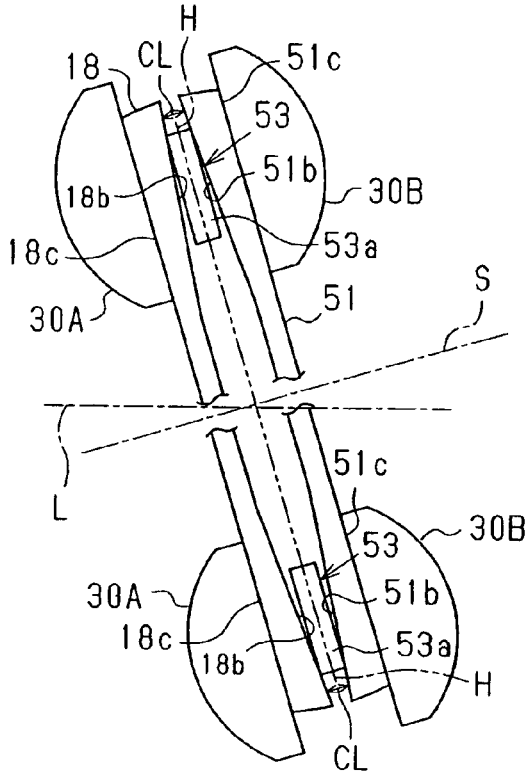
FIG. 6 is a schematic diagram showing the vicinity of a swash plate in another embodiment of the present invention.

Referring to FIG. 6, when the hypothetical plane H is located between the swash plate support surface 18*b* and the slide plate support surface 51*b*, the preferred embodiment may be modified so that the slide plate support surface 51*b* is inclined relative to the hypothetic plane H and gradually spaced from the hypothetical plane H radially inwardly of the slide plate 51.

Figure 7:
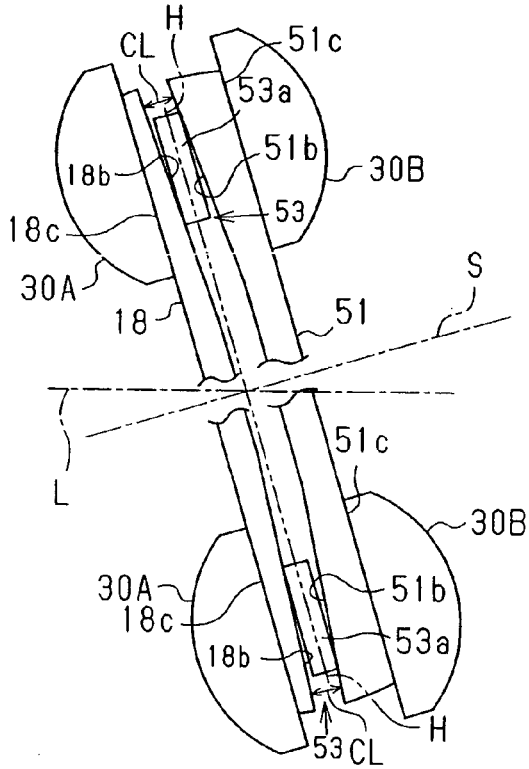
FIG. 7 is a schematic diagram showing the vicinity of a swash plate in a further embodiment of the present invention.

Referring to FIG. 7, when the hypothetical plane H is located between the swash plate support surface 18*b* and the slide plate support surface 51*b*, the embodiment of FIG. 6 may be modified so that the swash plate support surface 18*b* is inclined relative to the hypothetic plane H to gradually approach the hypothetic plane H radially inwardly of the swash plate 18. The inclination degree of the swash plate support surface 18*b* relative to the hypothetical plane H is smaller than the inclination degree of the slide plate support surface 51*b* relative to the hypothetical plane H. In other words, the angle of the swash plate support surface 18*b* relative to the hypothetical plane H is smaller than the angle of the slide plate support surface 51*b* relative to the hypothetical plane H. Accordingly, the clearance CL between the swash plate support surface 18*b* and the slide plate support surface 51*b* is gradually increased toward the radially inner side of the swash plate 18.

The swash plate support surface 18*b* may be parallel to the hypothetical plane H while the slide plate support surface 51*b* is inclined relative to the hypothetical plane H and gradually spaced from the swash plate support surface 18*b* radially inwardly of the slide plate 51.

In the preferred embodiment, as described in advantage (2), the slide plate 51 is flexible so that it flexes when a relatively small compression reaction X acts on the slide plate 51. However, the slide plate 51 may have any level of flexibility. For example, the flexibility of the slide plate 51 may be such that it flexes when the displacement of the compressor exceeds a predetermined value and the compression reaction X becomes greater than a predetermined value.

A race may be arranged between the swash plate support surface 18*b* and the rollers 53*a* and/or between the slide plate support surface 51*b* and the rollers 53*a*. That is, a race may be arranged on the thrust bearing 53. In this case, the swash plate support surface 18*b* and/or the slide plate support surface 51*b* on which the race is arranged does not function as a roll surface for the rollers 53*a* and only functions to support the race of the thrust bearing 53.

The present invention may be applied to a fixed displacement type swash plate compressor.

The present invention may be applied to a swash plate compressor using double-headed pistons.

The present examples and embodiments are to be considered as illustrative and not restrictive, and the invention is not to be limited to the details given herein, but may be modified within the scope and equivalence of the appended claims.

What is claimed is:

1. A swash plate compressor for compressing a gas, the compressor comprising:

a rotatable drive shaft;

a swash plate connected to the drive shaft in a manner enabling integral rotation with the drive shaft;

a slide plate supported to be rotatable relative to the swash plate;

a pair of shoes arranged on the swash plate and the slide plate;

a bearing arranged between the swash plate and the slide plate and in between the shoes; and a piston connected to the swash plate and the slide plate by the shoes, the piston being reciprocated to compress gas when the rotation of the drive shaft rotates the swash plate, wherein:

the swash plate includes a swash plate support surface for contacting the bearing;

the slide plate includes a slide plate support surface for contacting the bearing; and at least one of the swash plate and the slide plate is formed so that a clearance between the swash plate support surface and the slide plate support surface increases along a radial line, from a point radially farther away from the drive shaft toward a point radially closer to the drive shaft, and at least one of the swash plate support surface and the slide plate support surface is inclined relative to a hypothetical plane perpendicular to the axis of the swash plate so that the surfaces gradually increase in space from each other radially inwardly of the swash plate and the slide plate, and the clearance between the swash plate support surface and the slide plate support surface gradually increases radially inwardly of the swash plate and the slide plate.

2. The compressor according to claim 1, wherein the bearing includes a roller that rolls, and the swash plate support surface and the slide plate support surface each define a roller surface on which the roller rolls.

3. The compressor according to claim 1, wherein the slide plate is flexible.

4. The compressor according to claim 1, wherein the swash plate compressor forms part of a refrigerant circuit and compresses carbon dioxide refrigerant gas.

5. The compressor according to claim 1, wherein the other of the swash plate support surface and the slide plate support surface is parallel to a hypothetical plane perpendicular to the axis of the swash plate.

6. The compressor according to claim 1, wherein the swash plate support surface and the slide plate support surface are inclined relative to the hypothetical plane with the surfaces gradually increasing in space along the hypothetical plane, from a point radially farther away from the drive shaft toward a point radially closer to the drive shaft.

7. The compressor according to claim 1, wherein along a radial line, from a point radially farther away from the drive;

the other one of the swash plate support surface and the slide plate support surface is inclined relative to the hypothetical plane with the other one of the surfaces gradually decreasing in space from the hypothetical plane along a radial line, from a point radially farther away from the drive shaft toward a point radially closer to the drive shaft; and an angle between the hypothetical plane and the other one of the swash plate support surface and the slide plate support surface is smaller than an angle between the hypothetical plane and the one of the swash plate support surface and the slide plate support surface.

8. The compressor according to claim 1, wherein one of the swash plate support surface and the slide plate support surface is formed by part of a conical surface.

9. The compressor according to claim 1, wherein the clearance between the swash plate support surface and the slide plate support surface has a maximum value and a minimum value of which difference is 30 micrometers or greater.

* * * * *

UNITED STATES PATENT AND TRADEMARK OFFICE

CERTIFICATE OF CORRECTION

PATENT NO. : 7,168,359 B2
APPLICATION NO. : 11/020452
DATED : January 30, 2007
INVENTOR(S) : Masaki Ota et al.

It is certified that error appears in the above-identified patent and that said Letters Patent is hereby corrected as shown below:

On the Title page, in the Abstract Item (57)

Line 4, please delete "Two shoes is" and insert therefore -- Two shoes are --;

Line 5, please delete "A bearing arranged" and insert therefore -- A bearing is arranged --.

Column 1, lines 16-17, please delete "is in slidably contact" and insert therefore -- is in slidable contact --;

Column 1, line 29, please delete "plate 92 the shoes 93B" and insert therefore -- plate 92 and the shoes 93B --;

Column 1, line 30, please delete "plate 92)." and insert therefore -- plate 92. --;

Column 2, line 21, please delete "(as shown in upper part" and insert therefore -- (as shown in the upper part --;

Column 6, line 35, please delete "(refer to lower" and insert therefore -- (refer to the lower --; and Column 6, line 51, please delete "(refer to upper" and insert therefore -- (refer to the upper --.

In Claim 7, column 10, lines 16-17, please delete "wherein along a radial line, from a point radially farther away from the drive;" and insert therefore -- wherein --.

Signed and Sealed this

Thirteenth Day of October, 2009

David J. Kappos

David J. Kappos
*Director of the United States Patent and Trademark Office*